US007474735B2

(12) United States Patent
Spahn

(10) Patent No.: US 7,474,735 B2
(45) Date of Patent: Jan. 6, 2009

(54) ANTISCATTER GRID FOR REDUCING A SCATTERED RADIATION IN AN X-RAY MACHINE, AND X-RAY MACHINE HAVING AN ANTISCATTER GRID

(75) Inventor: Martin Spahn, Chicago, IL (US)

(73) Assignee: Siemens Aktiengesellschaft, Munich (DE)

( * ) Notice: Subject to any disclaimer, the term of this patent is extended or adjusted under 35 U.S.C. 154(b) by 74 days.

(21) Appl. No.: 11/592,126

(22) Filed: Nov. 3, 2006

(65) Prior Publication Data

US 2007/0104321 A1 May 10, 2007

(30) Foreign Application Priority Data

Nov. 7, 2005 (DE) ..... 10 2005 052 992

(51) Int. Cl.
*G21K 1/00* (2006.01)
*H05G 1/64* (2006.01)

(52) U.S. Cl. ..... 378/155; 378/98.8

(58) Field of Classification Search ..... 378/154, 378/155, 98.8
See application file for complete search history.

(56) References Cited

U.S. PATENT DOCUMENTS

| | | | | |
|---|---|---|---|---|
| 4,380,086 A | | 4/1983 | Vagi | |
| 5,040,202 A | | 8/1991 | Scheid | |
| 6,167,115 A | * | 12/2000 | Inoue | 378/155 |
| 6,304,632 B1 | * | 10/2001 | Rick et al. | 378/155 |
| 6,625,253 B1 | * | 9/2003 | Barnes et al. | 378/155 |
| 6,795,528 B2 | * | 9/2004 | Nokita | 378/155 |
| 7,099,430 B2 | | 8/2006 | Müller | |
| 7,202,481 B2 | | 4/2007 | Spahn et al. | |
| 2005/0117707 A1 | | 6/2005 | Baier et al. | |

FOREIGN PATENT DOCUMENTS

| | | |
|---|---|---|
| DE | 195 05 059 A1 | 2/1996 |
| DE | 10 2004 042 365 A1 | 4/2005 |
| DE | 10 2004 012 243 A1 | 9/2005 |

OTHER PUBLICATIONS

Morneburg, H.: Bildgebende Systeme für die medizinische Diagnostik. 3., wesentlich überarbeitete und erweiterte Auflage. Erlangen: Publicis MCD Verlag (1995). pp. 254-259. ISBN: 89878-002-2.

German Office Action dated Sep. 18, 2007.

Morneburg, H., "Imaging systems for medical diagnostics," X-ray diagnostics and angiography Computed tomography Nuclear medicine Magnetic resonance tomography Sonography Integrated Information systems, 3rd heavily revised and expanded edition, 1995, Publicis MCD Verlag.

* cited by examiner

*Primary Examiner*—Chih-Cheng G Kao
*Assistant Examiner*—Thomas R Artman
(74) *Attorney, Agent, or Firm*—Harness, Dickey & Pierce, P.L.C.

(57) ABSTRACT

To prevent an imaging of an antiscatter grid particularly effectively, even in the case of dynamic applications, an antiscatter grid is disclosed for an X-ray detector which exhibits an active pixel matrix. The antiscatter grid, in at least one embodiment, includes absorbing laminas, aligned substantially parallel to the direction of an X-radiation, for reducing a scattered radiation in an X-ray machine. The absorbing laminas are movable in a fashion perpendicular to the direction of the X-radiation at a minimum frequency value of 10 Hz, and at a maximum travel value of two pixel sizes of the X-ray detector that can be assigned to the antiscatter grid.

27 Claims, 1 Drawing Sheet

ANTISCATTER GRID FOR REDUCING A SCATTERED RADIATION IN AN X-RAY MACHINE, AND X-RAY MACHINE HAVING AN ANTISCATTER GRID

PRIORITY STATEMENT

The present application hereby claims priority under 35 U.S.C. §119 on German patent application number DE 10 2005 052 992.5 filed Nov. 7, 2005, the entire contents of which is hereby incorporated herein by reference.

FIELD

The invention generally relates to an antiscatter grid for reducing a scattered radiation in an X-ray machine, and/or to an X-ray machine with an antiscatter grid.

BACKGROUND

In X-ray imaging, scattered radiation frequently causes a reduction in the image quality and the signal-to-noise ratio in the display of an examination object. The scattered radiation is caused, for example, by classical scattering or the so-called Compton effect. An important method for reducing scattered radiation is the use of focused antiscatter grids.

These are generally made from thin absorbing laminas, for example, from lead, with interspaces constructed from a well medium, and are arranged in the beam path of the X-radiation perpendicular to the direction of the latter. The absorber laminas are aligned substantially parallel to the X-radiation or in a fashion focused on to the X-ray focus in such a way that scattered radiation impinging at various angles is filtered out.

Simple antiscatter grids have a maximum line number of approximately 40 lines per centimeter and are usually moved linearly in a fashion perpendicular to the direction of incident radiation at a low speed over a portion of the image area in order not to be visible later on the X-ray image as a striped structure or artifact. There is a need in this case to control and trigger so as to ensure that the movement of the antiscatter grid is coordinated with the emission of the X-radiation and is started in good time before radiation begins.

As an alternative to a movement of the antiscatter grid, the striped structure or the artifact can be corrected by software in the later X-ray image. Using the simple moving antiscatter grid is impossible in the case of rapid, dynamic X-ray imaging methods, because of the rapid image sequence, while using the software correction is very expensive because of the long computing times. Dynamic X-ray imaging methods are understood, for example, as fluoroscopy, angiography, cardioangiography, and various 3-D recording methods.

If simple antiscatter grids with digital X-ray detectors are used, disturbing interference can arise between the regularly arranged absorbing laminas and the pixel structure of the digital X-ray detector, producing so-called Moiré structures. Multiline antiscatter grids that have a high number of, for example, 70 or more lines per centimeter have been developed in order to reduce these Moiré structures. The production of these multiline antiscatter grids is, however, very expensive and complicated, and it is therefore impossible to suppress striped structures or artifacts completely.

SUMMARY

In at least one embodiment of the invention, an antiscatter grid and/or an X-ray machine for an antiscatter grid is provided, that creates a particularly effective suppression both of scattered radiation and of interfering striped structures and artifacts, caused by absorbing laminas, on the X-ray image. This can occur, for example, even in the case of dynamic X-ray imaging methods at as low a production cost.

An antiscatter grid, in at least one embodiment, is for reducing a scattered radiation in an X-ray machine. In at least one embodiment, an X-ray machine with an antiscatter grid is disclosed.

Owing to its absorbing laminas that are aligned substantially parallel to the direction of the (primary) X-radiation, the antiscatter grid according to at least one embodiment of the invention reduces scattered radiation, which generally impinges on the antiscatter grid at various angles. Owing to its movement at a frequency of at least 10 Hz, the antiscatter grid according to at least one embodiment of the invention prevents the absorbing laminas from being imaged on to the X-ray image even at the point of reversal of the to and fro movement, and artifacts that are caused by the absorbing laminas could be suppressed.

The to and fro movement is understood here as a movement that is substantially perpendicular to the direction of the X-radiation and substantially perpendicular to the direction in which the absorbing laminas extend. Designated as the travel is the path which is covered by the absorbing laminas when moving to and from between the two points of reversal.

An alignment of the absorbing laminas in a fashion substantially parallel to the direction of the (primary) X-radiation, in this case likewise includes a focused alignment of the absorbing laminas with the X-ray focus of the (primary) X-radiation.

Particularly in the case of dynamic X-ray applications with very short X-ray pulses of, for example, 10 ms at 30 X-ray images per second, the interplay between a relatively high frequency and low maximum travel value ensures transparency of the antiscatter grid for the regular X-radiation, that is to say the X-radiation required for the X-ray imaging of the examination object. Frequencies between 100 Hz and 500 Hz, for example, are particularly suitable for general customary X-ray pulses between 4 ms and 15 ms.

Moreover, the movement to and fro or forward and backward provides a particular suitability of the antiscatter grid for dynamic applications. Thus, there is no need for a complicated and time-intensive triggering of the grid movement at a specific instant as in the case of the known antiscatter grids. Accordingly, an antiscatter grid according to at least one embodiment of the invention can be used to carry out rapidly succeeding X-ray recordings without the occurrence of interfering time delays between the recordings.

The requirements placed on the quality and the number of the absorbing laminas per cm of the antiscatter grid is reduced by the blurring of the imaging of the absorbing laminas by high frequency and short travel. Thus, the antiscatter grid can be fabricated with less complication and therefore also more cost effectively.

The antiscatter grid can be moved to and fro at a minimum frequency value of 150 Hz in an advantageous way with a particularly good suppression of an imaging of the antiscatter grid onto the X-ray image. According to one refinement of at least one embodiment of the invention, the antiscatter grid can, moreover, be moved to and fro with a travel value of substantially one pixel size of the X-ray detector that can be assigned to the antiscatter grid.

If, according to a further refinement of at least one embodiment of the invention, the antiscatter grid has at most 70 absorbing laminas per centimeter, it can be produced with a particularly low degree of complexity and thus cost effectively. Such an antiscatter grid can be used with particular advantage in dynamic applications.

According to a further refinement of at least one embodiment of the invention, the antiscatter grid is moved by means of at least one piezoactuator. Precise movements are possible at high frequency to a particular degree by way of piezoactuators. Moreover, such actuators have small external dimensions and can therefore be accommodated in a space-saving fashion in the housing of the antiscatter grid.

A particularly advantageous possibility of using an inventive antiscatter grid of at least one embodiment occurs in the case of an X-ray machine having a digital flat image detector, in particular in the case of an X-ray machine for carrying out dynamic X-ray imaging methods. Owing to the fast movements of the antiscatter grid at high frequency, it is possible to avoid Moiré structures even without using a multiline grid.

BRIEF DESCRIPTION OF THE DRAWINGS

The invention and further advantageous refinements in accordance with the features of the subclaims are explained in more detail below with the aid of schematically illustrated example embodiments in the drawings, without thereby limiting the invention to these example embodiments; in the drawings:

DETAILED DESCRIPTION OF THE EXAMPLE EMBODIMENTS

Figure 1:
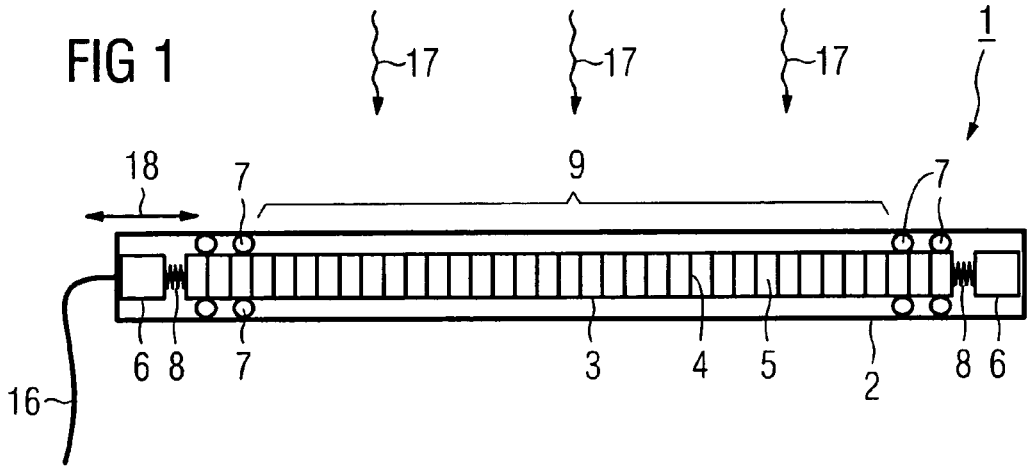
FIG. 1 shows an antiscatter grid according to an embodiment of the invention with actuators and bearings for being moved to and fro.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described.

FIG. 1 shows an antiscatter grid 1 according to an embodiment of the invention, the absorbing laminas 4 of which can be moved to and fro in a fashion perpendicular to the direction of an X-radiation 17 at a minimum frequency value of 100 Hz and at a maximum travel value of two pixel sizes of the X-ray detector that can be assigned to the antiscatter grid. The direction of movement is specified with the aid of the arrows 18. The antiscatter grid 1 in this case has a housing 2 that is transparent to X-rays and in which the actual raw grid 3 composed of a multiplicity of parallel absorbing laminas 4 and intermediate layers 5 located therebetween is arranged. The absorbing laminas 4 can be made of, for example, lead or another material that absorbs radiation strongly and the intermediate layers 5 be made of, for example, paper or aluminum.

So that it can be produced with as little complexity as possible in conjunction with a high number of lines, the antiscatter grid advantageously has at most 70 lines, that is to say absorbing laminas 4, per centimeter. The antiscatter grid can also have 60 or even more few, for example 40, lines per centimeter. In this context, the advantage of a relatively low number of line pairs resides in that the height of the absorbing laminas in the direction of the X-radiation can be selected to be low in conjunction with the low number of line pairs, and as a result of this the alignment of the absorbing laminas need be set less exactly parallel to the X-radiation or in a fashion focused on to the X-ray focus, and yet a good recording quality is ensured.

The absorbing laminas 4 are moved to and fro via actuators. According to one refinement of an embodiment of the invention, piezoactuators 6 are used to move the absorbing laminas 4. Since the latter are particularly small, they can be arranged within the housing 3. Moreover, the piezoactuators 6 have the advantage of being particularly energy-saving and thus both of producing a low level of waste heat and of making only slight demands on energy saving. When a voltage is applied to a piezoactuator 6, the latter is deformed and can thus be used for to and fro movements whose frequencies can be set precisely.

In FIG. 1, piezoactuators 6 are arranged at both ends of the raw grid 3, and are driven in phased opposition by a control unit (not shown). However, it is also possible to provide one or more piezoactuators 6 at one end and spring elements at the respective other end. The order of magnitude of the travel is advantageously approximately in the range of one pixel size of an X-ray detector 11 that is assigned the antiscatter grid for an X-ray examination; the travel value can, however, also be less than a pixel size. In general, the size of a pixel is approximately 100 μm to 200 μm. The effective grid surface 9, that is to say the surface that can be used for absorbing scattered radiation, corresponds in an ideal case to the active surface of the X-ray detector but can also be larger.

The raw grid 3 is supported inside the housing 2 on bearings 7 so as to enable a to and fro movement free from friction. Roller, ball, or plain bearings can be used as bearings 7. An air bearing is also possible, for example, as an alternative.

Figure 2:
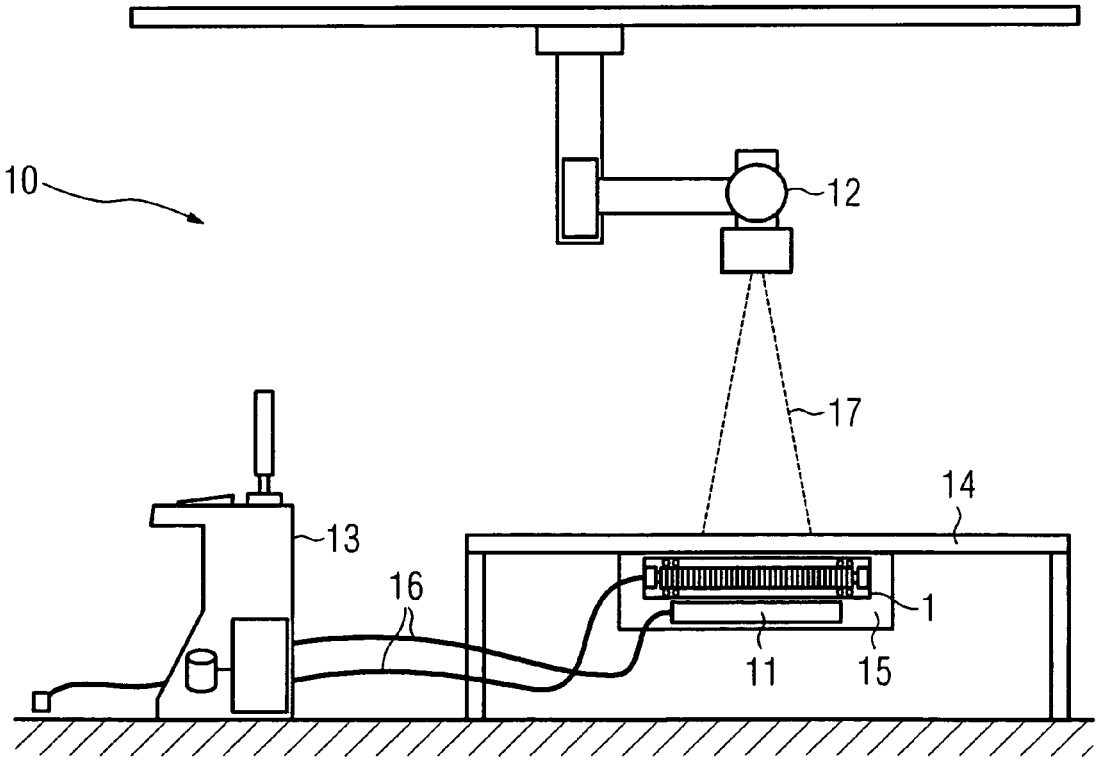
FIG. 2 shows an X-ray machine with an antiscatter grid according to an embodiment of the invention that is arranged in a Bucky drawer, and a digital X-ray detector.

FIG. 2 shows an X-ray machine 10 in which the antiscatter grid 1 according to an embodiment of the invention is integrated. The X-ray machine 10 has an assigned X-ray detector 1, an X-ray source 12 and a control device 13 with an image system. The X-ray detector 11 is, for example a digital, mobile flat image detector that is arranged in a Bucky table 14 or the Bucky drawer 15 thereof, and is connected to the control device 13 by cable via a communication link 16, or without a cable. The antiscatter grid 1 is arranged upstream of the flat image detector 11 in the direction of the X-radiation 17, for example likewise in the Bucky drawer 15 and comes into contact with the control device 13 via a communication link 16.

At least one embodiment of the invention may be summarized briefly in the following way: in order to prevent an imaging of an antiscatter grid 1 with particular effectiveness even during dynamic applications, an antiscatter grid 1 for an X-ray detector 11 is provided which exhibits an active pixel matrix and has absorbing laminas 4, aligned substantially parallel to the direction of an X-radiation 17, for reducing a scattered radiation in an X-ray machine 10, it being possible to move the absorbing laminas 4 to and fro in a fashion perpendicular to the direction of the X-radiation 17 at a minimum frequency value of 10 Hz, in particular of 150 Hz, and with a maximum travel value of two pixel sizes of the X-ray detector 11 that can be assigned to the antiscatter grid 1.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An antiscatter grid for an X-ray detector exhibiting an active pixel matrix, comprising:

absorbing laminas, aligned substantially parallel to a direction of an X-radiation, to reduce a scattered radiation in an X-ray machine, the absorbing laminas being movable in a fashion perpendicular to the direction of the X-radiation at a minimum frequency value of 10 Hz and at a maximum travel value of two pixel sizes of the X-ray detector assignable to the antiscatter grid, the absorbing laminas being movable by at least one piezoactuator.

2. The antiscatter grid as claimed in claim 1, wherein the absorbing laminas are movable at a minimum frequency value of 150 Hz.

3. The antiscatter grid as claimed in claim 1, wherein the absorbing laminas are movable with a travel value of substantially one pixel size of the X-ray detector assignable to the antiscatter grid.

4. The antiscatter grid as claimed in claim 1, wherein the antiscatter grid includes at least 50 absorbing laminas per centimeter.

5. The antiscatter grid as claimed in claim 1, wherein the antiscatter grid includes at most 70 absorbing laminas per centimeter.

6. The antiscatter grid as claimed in claim 1, wherein the antiscatter grid is assigned to an X-ray machine for carrying out dynamic X-ray imaging methods.

7. The antiscatter grid as claimed in claim 1, wherein the X-ray detector is a digital flat image detector.

8. An X-ray machine comprising:

an antiscatter grid, including absorbing laminas aligned substantially parallel to a direction of an X-radiation, to reduce a scattered radiation; and an X-ray detector exhibiting an active pixel matrix, the absorbing laminas being movable in a fashion perpendicular to the direction of the X-radiation at a minimum frequency value of 10 Hz and with a maximum travel value of two pixel sizes of the X-ray detector, the absorbing laminas being movable by at least one piezoactuator.

9. The X-ray machine as claimed in claim 8, wherein the absorbing laminas are movable at a minimum frequency value of 150 Hz.

10. The X-ray machine as claimed in claim 8, wherein the absorbing laminas are movable with a travel value of substantially one pixel size of the X-ray detector.

11. The X-ray machine as claimed in claim 8, wherein the antiscatter grid includes at least 50 absorbing laminas per centimeter.

12. The X-ray machine as claimed in claim 8, wherein the antiscatter grid includes at most 70 absorbing laminas per centimeter.

13. The X-ray machine as claimed in claim 8, wherein the X-ray detector is a digital flat image detector.

14. The X-ray machine as claimed in claim 13, wherein the digital flat image detector and the antiscatter grid are jointly arranged in a Bucky drawer.

15. The X-ray machine as claimed in claim 8, wherein the X-ray machine is designed for carrying out dynamic X-ray imaging methods.

16. The X-ray machine as claimed in claim 15, wherein the X-ray detector is a digital flat image detector and wherein the digital flat image detector and the antiscatter grid are jointly arranged in a Bucky drawer.

17. An X-ray machine comprising:

an antiscatter grid, including absorbing laminas aligned substantially parallel to a direction of an X-radiation, to reduce a scattered radiation; and an X-ray detector exhibiting an active pixel matrix, the absorbing laminas being movable, in a fashion perpendicular to the direction of the X-radiation, at least one of at a frequency value of at least 10 Hz and at a travel value of at most two pixel sizes of the X-ray detector, the absorbing laminas being movable by at least one piezoactuator.

18. The X-ray machine as claimed in claim 17, wherein the absorbing laminas are movable at a frequency value of at least 150 Hz.

19. The X-ray machine as claimed in claim 17, wherein the absorbing laminas are movable at a travel value of at most, substantially one pixel size of the X-ray detector.

20. The X-ray machine as claimed in claim 17, wherein the X-ray detector is a digital flat image detector.

21. The X-ray machine as claimed in claim 20, wherein the digital flat image detector and the antiscatter grid are jointly arranged in a Bucky drawer.

22. The X-ray machine as claimed in claim 17, wherein the X-ray machine is designed for carrying out dynamic X-ray imaging methods.

23. An antiscatter grid for an X-ray detector exhibiting an active pixel matrix, comprising:

absorbing laminas, aligned substantially parallel to a direction of an X-radiation, to reduce a scattered radiation in an X-ray machine, the absorbing laminas being movable, in a fashion perpendicular to the direction of the X-radiation, at least one of at a frequency value of at least 10 Hz and at a travel value of at most two pixel sizes of the X-ray detector assignable to the antiscatter grid; the absorbing laminas being movable by at least one piezoactuator.

24. The antiscatter grid as claimed in claim 23, wherein the absorbing laminas are movable at a frequency value of at least 150 Hz.

25. The antiscatter grid as claimed in claim 23, wherein the absorbing laminas are movable with a travel value of at most, substantially one pixel size of the X-ray detector assignable to the antiscatter grid.

26. The antiscatter grid as claimed in claim 23, wherein the antiscatter grid includes at least 50 absorbing laminas per centimeter.

27. The antiscatter grid as claimed in claim 23, wherein the antiscatter grid includes at most 70 absorbing laminas per centimeter.

* * * * *